US005611668A

United States Patent [19]

Yapp et al.

[11] Patent Number: 5,611,668

[45] Date of Patent: Mar. 18, 1997

[54] MULTI-PART INJECTION-MOLDED PLASTIC FAN

[75] Inventors: Martin G. Yapp, Needham, Mass.; Richard L. Matsu, Plymouth, Mich.

[73] Assignee: Bosch Automotive Motor Systems, Inc., Waltham, Mass.

[21] Appl. No.: 491,248

[22] Filed: Jun. 16, 1995

[51] Int. Cl.[6] ..... F04D 29/32

[52] U.S. Cl. ..... 416/189; 416/191; 416/238; 416/244 R

[58] Field of Search ..... 416/189, 191, 416/212 R, 193 A, 214 R, 238, 244 R

[56] References Cited

U.S. PATENT DOCUMENTS

| | | | |
|---|---|---|---|
| 47,137 | 4/1865 | Sutherland | 416/212 R |
| 1,518,501 | 12/1924 | Gill | 416/189 |
| 1,724,604 | 8/1929 | Lambert | 416/189 |
| 3,241,493 | 3/1966 | Frey | 416/244 R |
| 3,791,762 | 2/1974 | Brehme | 416/212 R |
| 4,358,245 | 11/1982 | Gray . | |
| 4,569,632 | 2/1986 | Gray, III . | |
| 5,297,931 | 3/1994 | Yapp et al. | 416/223 R |
| 5,489,186 | 2/1996 | Yapp et al. . | |

FOREIGN PATENT DOCUMENTS

| | | | |
|---|---|---|---|
| 997656 | 1/1952 | France | 416/244 R |
| 723230 | 4/1980 | U.S.S.R. | 416/212 R |

OTHER PUBLICATIONS

Abstract of JP A 6-10894, Matsushita Electric Works, Ltd, Jan. 21, 1994.

*Primary Examiner*—James Larson

*Attorney, Agent, or Firm*—Fish & Richardson P.C.

[57] ABSTRACT

A plastic fan includes two injection molded parts, each of which includes its own hub and a set blades extending outwardly from the hub to a band. The two parts are co-operatively sized and shaped to be assembled into a single operable fan having: 1) a hub comprising the hubs of each of the component parts; 2) the blades of the component parts; and 3) a circumferential band comprising the bands of the component parts. The fan blade separation on each of the fan parts is relatively large, permitting separate injection molding of each part. The resulting fan may be designed to have far greater blade number and blade solidity that would be possible for a fan that is injection molded by standard techniques. The fan may be packaged in an airhandler assembly that includes a flexible cylindrical retraining member generally coaxial with, and external to, a rigid cylindrical member, the fan band and the stator assembly, so as to support the stator assembly and to maintain the parts in place. A conical airguide may be positioned axially between the fan assembly and the stators. Also disclosed are methods of assembling the airhandler described above; and a bell mouth airguide that guides airflow smoothly into the round fan.

20 Claims, 12 Drawing Sheets

MULTI-PART INJECTION-MOLDED PLASTIC FAN

FIELD OF THE INVENTION

This invention relates to the general field of injection molded fans, particularly those used in automotive or in building HVAC (heating, ventilation, air conditioning) applications.

BACKGROUND OF THE INVENTION

Plastic injection molded fans have been known for some time. See, for example, U.S. Pat. No. 4,569,632, which discloses a fan having back-skewed blades formed of a high-strength injection molded plastic. See also U.S. Pat. No. 4,358,245, which discloses an injection molded fan having blades that are highly forwardly skewed.

Typically, injection molded fans are produced by introducing molten plastic into a mold, and then opening the mold along a parting line to remove the cooled solid fan. The fan must be designed to permit removal from its mold.

SUMMARY OF THE INVENTION

I have discovered that injection molding a fan in two or more parts enhances the fan designer's range of options (particularly as to the number of blades and blade solidity) for quiet and efficient fans. Thus, one aspect of the invention features a plastic fan comprising two injection molded parts, each of which includes its own hub and a set blades extending outwardly from the hub to a band. The two parts are co-operatively sized and shaped to be assembled into a single operable fan having: 1) a hub comprising the hubs of each of the component parts; 2) the blades of the component parts; and 3) a circumferential band comprising the bands of the component parts. The blade-to-blade separation on each of the fan parts is relatively large, permitting separate injection molding of each part, yet the resulting assembled fan may have greater blade number and blade solidity than would be possible for a fan that is injection molded as a single part by standard techniques. For example, a projection of the blades of the assembled two-part fan in a plane perpendicular to the fan axis covers at least 80% (preferably over 95%) of the projected fan area between $R_0$, the radius of the hub of the fan and R, the radius at the tip of the fan blades. See FIG. 3. Each set of blades can easily include 5 blades, giving the fan 10 blades total; higher numbers of blades, e.g., 14–22 blades total are readily obtainable. Generally, the total number of blades in the is fewer than 30. In general, we have found fans with an even number of blades, particularly 20 or 22 blades, exhibit particularly good acoustical properties. The blades of the assembled fan are arrayed symmetrically around the fan axis, with blades from the two parts alternating around the circumference.

Generally, one hub is axially forward of the other hub. The fan blades are raked forwardly to provide axial pressure forcing the two fan parts together. The forward hub comprises an irregular trailing edge and the rearward hub comprises a mating irregular leading edge. For example, the edges can be shaped as mating castellations which support and stabilize the blade edges to reduce deformation resulting from centrifugal forces of operation. The forward face of the forward hub may be rounded, presenting a smooth surface to incoming airflow.

Preferably, in the range of radial positions between r/R=0.76 and r/R=0.99, the blades are characterized by essentially straight leading edges. For example, X<0.03L, where X is the maximum distance between the leading edge (LE) and L, a straight line connecting the leading edge at 0.99 R with the leading edge at 0.76 R. See FIG. 4. Also preferably, the leading edges of the blades are forwardly skewed, for example, the mid-chord skew of the fan blades is between 17 and 25 degrees. Fasteners (e.g., screws) may be used to fix the two hubs together. Preferably, the bands on each of the respective component parts extends circumferentially around the part, with the forward band comprising an irregular trailing edge and the rearward band comprising an irregular leading edge that mates with the trailing edge of the forward band.

The above-described fan may be packaged in an airhandler assembly that includes a flexible cylindrical wrapping member generally coaxial with, and external to, a rigid cylindrical support and a stator assembly, so as to support the assembly and to maintain the parts in place. The stator assembly is downstream from the fan assembly, and it comprises aerodynamic flow-control vanes extending outwardly from a motor support to outer surfaces for engaging the wrapping member. Preferably, the rigid cylindrical support includes a leakage vane assembly (positioned upstream from the fan assembly) which comprises concentric rings connected by vanes that have aerodynamic flow-control surfaces to guide recirculating airflow into the fan assembly inlet. An airguide (e.g., conical in shape) may be positioned axially between the fan and the stators. Preferably, the flexible wrapping member is attached to: a) the leakage vane ring; b) the airguide; and c) the outer stator support surfaces. The fan band may include a lip positioned downstream of the recirculation flow-control surface, so the lip and the rigid ring establish a pathway for recirculating airflow.

In another aspect, the invention includes a method of assembling the airhandler described above in which the stator assembly (together an attached motor and a fan fixed to the motor) are balanced and then positioned in a fixture. The flexible conical airguide is manipulated over the fan, and then the rigid cylindrical support is positioned in the fixture ahead of the fan. At that point, the flexible cylindrical wrapper is provided as a planar sheet and formed into a cylinder wrapped around the stator assembly, the rigid cylindrical support, and the flexible conical airguide. The edges of the wrapper member are fixed together to form it into a cylinder that holds the parts in position.

In still another aspect, the invention features an airhandler assembly having a fan and stator members having flow control surfaces mounted downstream of the fan. A conical airguide is positioned between the fan and stators, to guide airflow from the fan to the stators.

Finally, in still another aspect, the invention features an airhandler assembly comprising a fan positioned to draw air through at least one heat exchanger having a rectilinear profile and from there into a curved (round) fan opening. An airguide is positioned between a rectilinear heat exchanger and the fan opening, to guide airflow smoothly from the heat exchanger into the fan. The airguide comprises at least one curved elongated surface extending along one linear extent of the heat exchanger; the curved surface turns axially to form an axisymmetric bell mouth at the fan opening. In preferred embodiments of this aspect of the invention, the heat exchanger is an evaporator for cooling, and the assembly is designed to be positioned so that the fan is below the evaporator. The curved elongated surface comprises a condensate conduit for removing condensate that drips down from the evaporator. Jet openings may be included in the elongated curved surface to maintain airflow attachment to the curved surface.

Other aspects of the invention will be apparent from the following description of the preferred embodiment and from the claims.

DESCRIPTION OF THE PREFERRED EMBODIMENTS

I. Two-Part Fan Design

Figure 1:
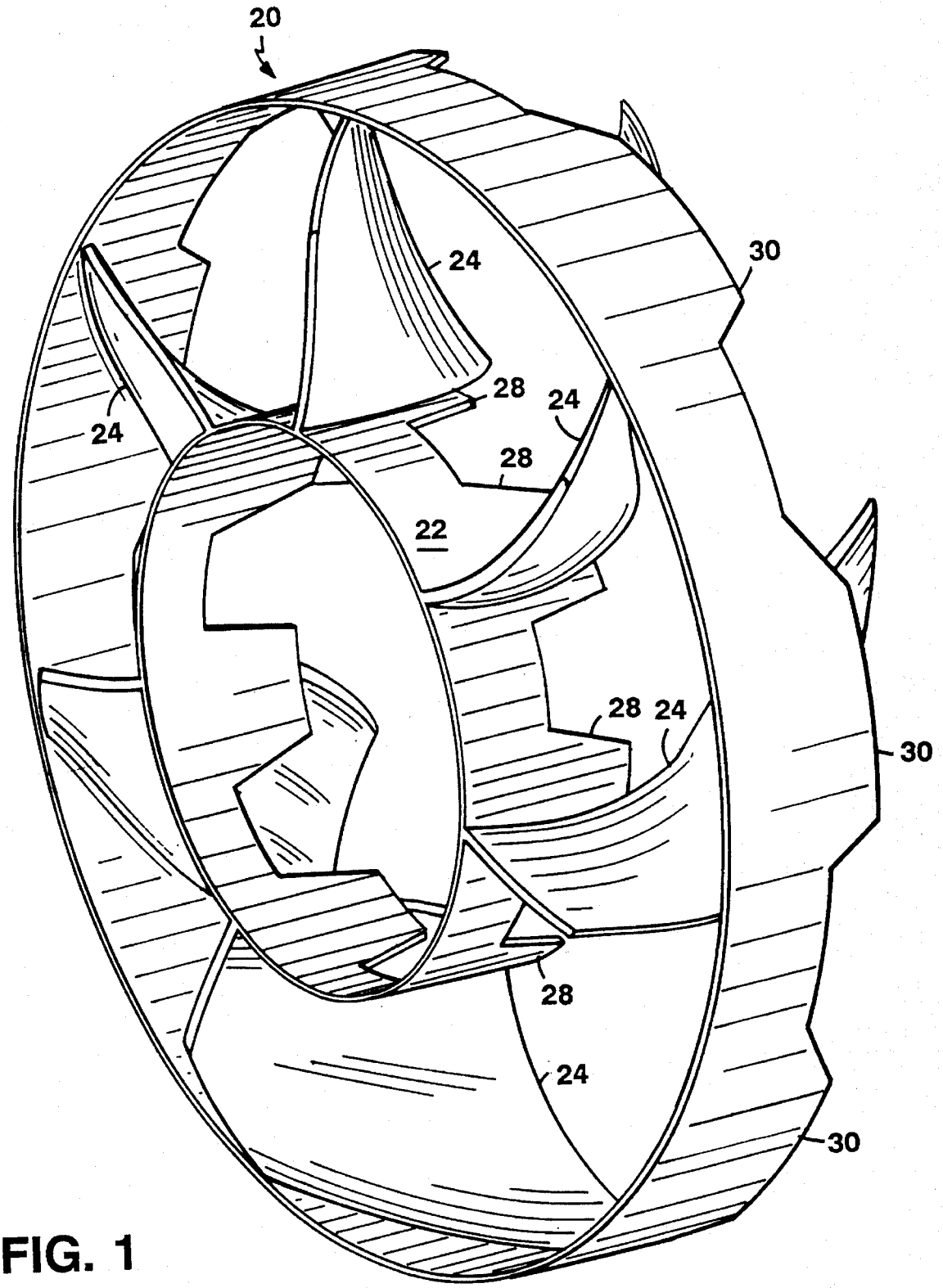
FIG. 1 is a view of the axially rearward ("trailing") part of a two-part 14-bladed fan (one blade and part of the hub are omitted for clarity).
Figure 2:
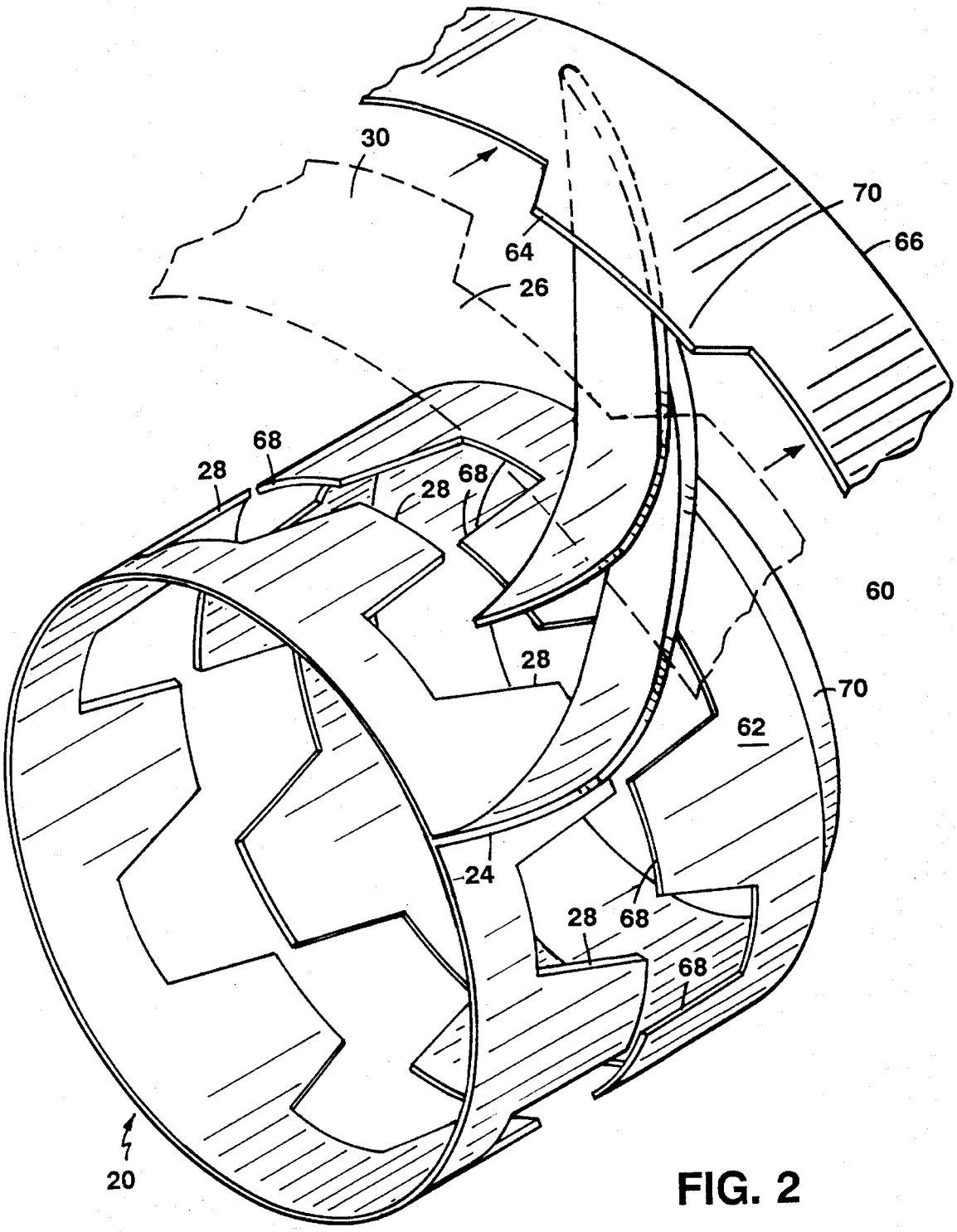
FIG. 2 is a exploded view of two fan parts, the part of FIG. 1 and a second part that mates in position axially forward of the part of FIG. 1; the circumferential band and all but two fan blades are omitted from FIG. 2 for clarity.

FIGS. 1 and 2 show fan parts 20 and 60 for a two-part, fourteen-bladed fan 10. In FIG. 1, axially rearward part 20 includes a central hub 22 from which blades 24 extend. A band 26 connects the tips of blades 24. Part 60 is the axially forward fan part, and it similarly includes blades 64 (one of seven shown in FIG. 2) extending outwardly from hub 62. Part 60 also includes a circumferential band 66. The forward (from the perspective of airflow) edge of hub 22 includes castellations 28 which mate with spaces between castellations 68 on the rearward edge of hub 62 of part 60. The axially forward face 70 of hub 62 is rounded to present a smooth surface to incoming airflow. Band 26 also includes castellations 30 which mate with castellations 70 on the band of part 60. The castellations support and stabilize the blade edges to reduce deformation resulting from the centrifugal forces of operation.

Each of fan parts 20 and 60 is a single injection molded part. When assembled as in FIG. 5A, parts 20 and 60 form a two-part fan 80 which operates as a unitary fan having one set of fourteen blades 88 and one circumferential band 86. Blades 88 are evenly spaced around its circumference. The fourteen blades consist of seven blades 24 from part 20 and seven blades 64 from part 60. Blades 24 alternate with blades 64 around the circumference of fan 80.

One feature of the invention is a wider choice of blade number and configurations. For example, while parts 20 and 60 are readily injection molded by well-known techniques, it would be essentially impossible with a rigid material to mold a single fourteen-bladed fan comparable to fan 80.

In known injection molding processes, a rectangular injection mold includes two halves which define a mold cavity for a one-piece injection molded fan. Molten plastic is introduced into ports (runners) to fill the cavity. After the resulting plastic part cools, the mold is opened along a parting line. The fan is removed by an ejector system, usually by means of a moving ring which dislodges the band, and a set of pins which dislodge the hub area. Generally, the geometry of the part must be such that the surrounding solid mold can be preserved while the part is ejected—i.e., the mold does not interfere with part removal. High projected blade solidity (in which one blade "shades" the adjacent blade) can make removal of a one-piece fan extremely difficult, if not impractical or impossible in an assembly line process.

The higher blade number afforded by the invention can reduce noise. Specifically, one aspect of fan noise is a tone at the Blade Passing Frequency (BPF) and at harmonics of BPF. BPF can be a significant factor, at times even more important than overall broadband dBA noise ratings, in a variety of applications including some airhandler fans for heating and air conditioning. BPF is a function of fan rotational velocity (revolutions per second) and the number of blades (blades per revolution). Tones generally diminish as blade number increases. A different aspect of noise, known as broadband noise, is generally a function of blade aerodynamic loading, and, since loading of individual blades is generally an inverse function of blade number×chord, broadband noise also tends to diminish as blade number increases (so long as chord increases, is constant, or decreases more slowly than number increases). Conveniently, BPF tone level also tends to diminish as blade loading decreases. So, generally, increasing the number of blades can reduce both broadband and BPF noise. FIG. 3B is a computer-generated representation of the blades of the fan of FIG. 2, showing shaded areas in which blades overlap in axial section.

Generally, noise-related advantages of increased blade number can be achieved with 12 or more blades. Aerodynamic thrust maximizes and then declines with increasing blade number (e.g. over 14). Injection molding considerations (the number of mold shut-offs) may offset any diminishing noise advantages as blade number increases. We have also found that fans with an even number of blades tend to exhibit improved acoustical performance compared to corresponding fans with one more blade.

In sum, we often find that fans of 12–16 blades are preferred. However, in some applications, we have found that fans having 18–22 blades (particularly 20 or 22 blades) exhibit improved noise-related performance. In fans with more than 18 blades, some of the acoustic response is smeared, rather than being a discrete set of frequencies as might characterize the same response in a fan with fewer blades. We believe this phenomenon applies particularly to airhandler fans used in conjunction with V-configured heat exchangers.

Figure 3A:
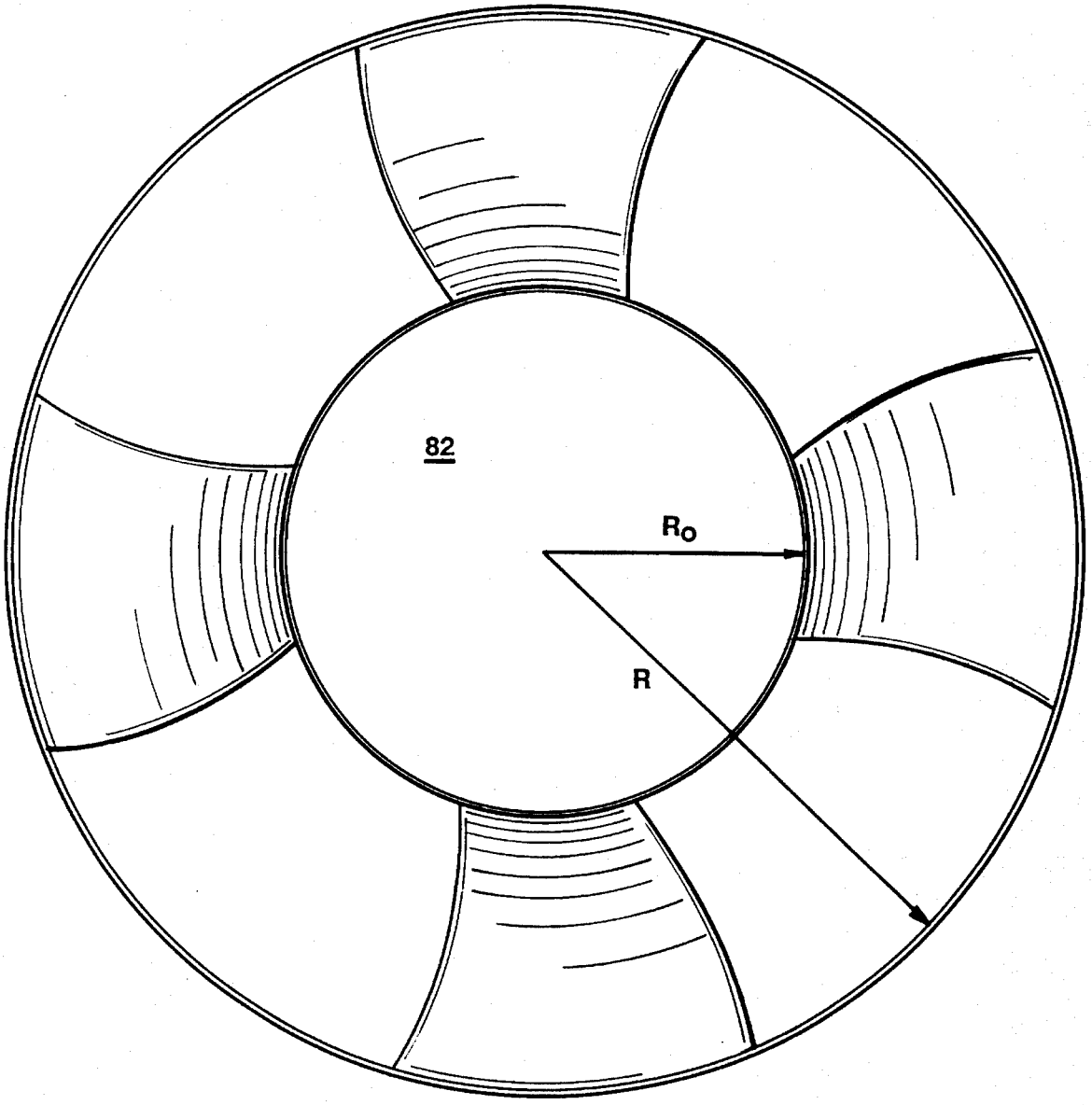
FIG. 3A illustrates a determination of blade solidity (projected onto a plane perpendicular to the fan axis) for an arbitrary fan design.
Figure 3B:
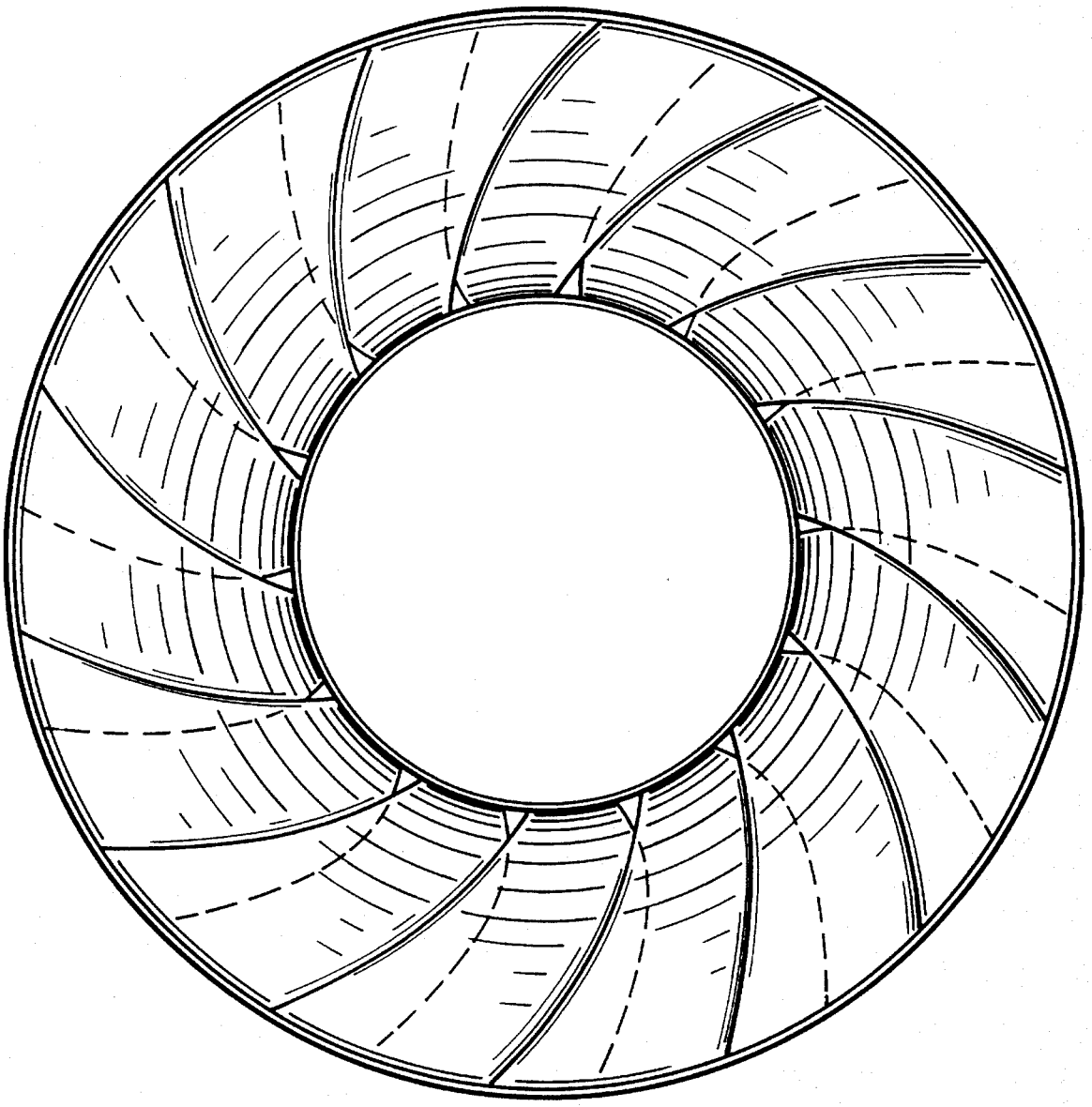
FIG. 3B is a gridded computer-generated representation of the blades of the fan of FIGS. 1 and 2.

The higher projected blade solidity afforded by the invention is illustrated in FIG. 3A for an arbitrary fan (not necessarily embodying the invention) by the projection of the blades in a plane perpendicular to the axis of the fan. According to preferred embodiments of the invention, the area between $R_o$, the radius of hub, and R, the radius of the fan blades is substantially (at least 80% and preferably at least 95%) covered by this projection. Indeed, the area is essentially entirely (over 99%) covered by the projection of the blades of the fan 80. FIG. 3B is a computer-generated representation of the blades of the fan of FIG. 2, showing shaded areas in which blades overlap in axial section.

As shown in FIG. 2, the two fan parts are positioned axially, one in back of the other. In order to provide a fan-rotation-generated force component that keeps the parts together during operation/rotation, the blades are designed with a forward rake, as taught by, or even in excess of that taught by, co-owned U.S. Pat. No. 5,297,931, hereby incorporated by reference. The rake is determined from the difference in axial position of the trailing edge of the blade at $R_O$ (the hub) and R (the tip). If the trailing edge at the tip is axially forward of the trailing edge at the root, the blade is said to be forwardly raked.

In general, we prefer blades that are forwardly skewed (i.e., at the tip, both the leading edge and the mid-chord line are rotationally advanced compared to their hub positions). By keeping the blade leading edges (which are forwardly swept) substantially straight in the region $0.76<r/R<1.00$, BPF tones may be reduced.

In other respects, blade shape (pitch, camber, skew, chordwise camber) may be designed in accordance with the '931 patent referenced above. It may be desirable to limit the camber near the blade roots of spanwise gridlines, in order to limit local loading and thus allow use of a smaller hub diameter which increases efficiency.

Figure 4:
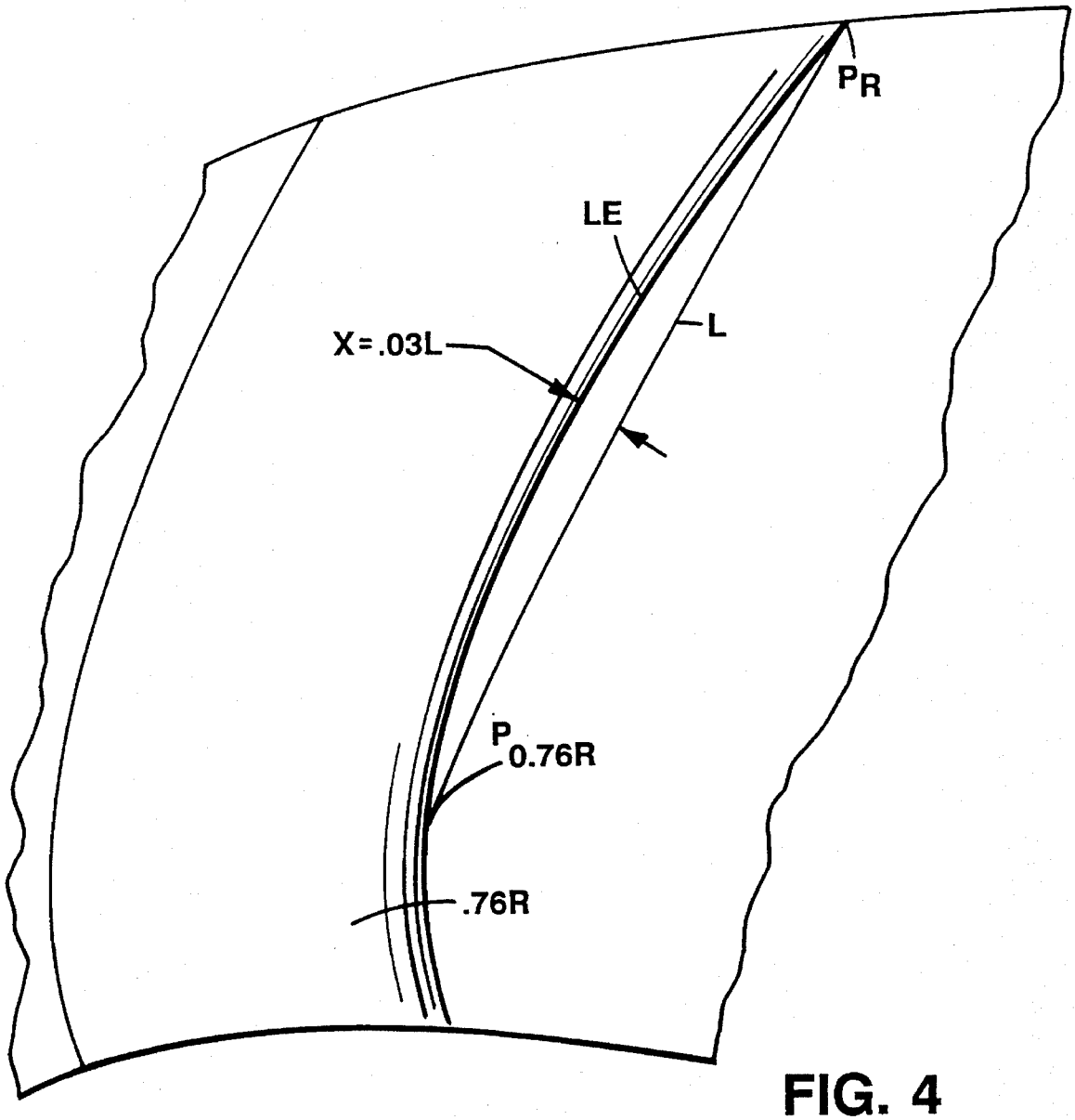
FIG. 4 illustrates dimensions used to calculate blade curvature.

FIG. 4 is a highly schematic illustration, with exaggerated curvature to illustrate a method of determining blade leading edge curvature in the outer half of a forwardly swept blade B. A line L is drawn from $P_{0.76R}$ (the point on the leading edge (LE) at a radius of 0.76 R where R is the radius of the tip of the blade) to $P_R$, the leading edge at the tip of the blade. Because the leading edge is forwardly swept, there is a maximum distance X between line L and LE (X can be measured by cutting a straight edge to fit between 0.76 R and 1.00 R, and using a feeler gauge to measure X).

II. Airhandler Design and Assembly

Figure 5A:
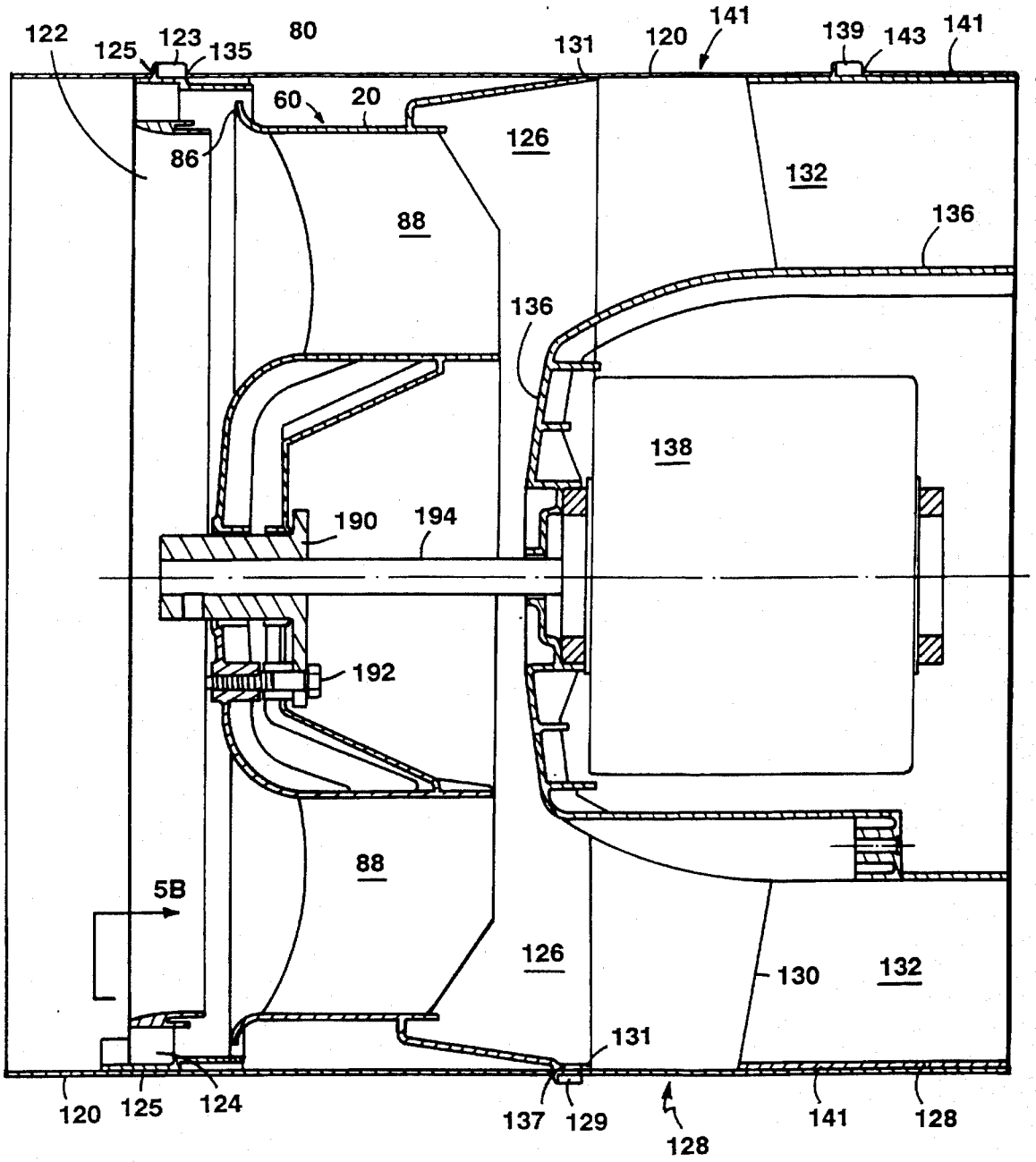
FIGS. 5A and 5B illustrate an airhandler assembly and evaporator, including a conical airguide between the fan and stators, and recirculation flow-control vanes.
Figure 5B:
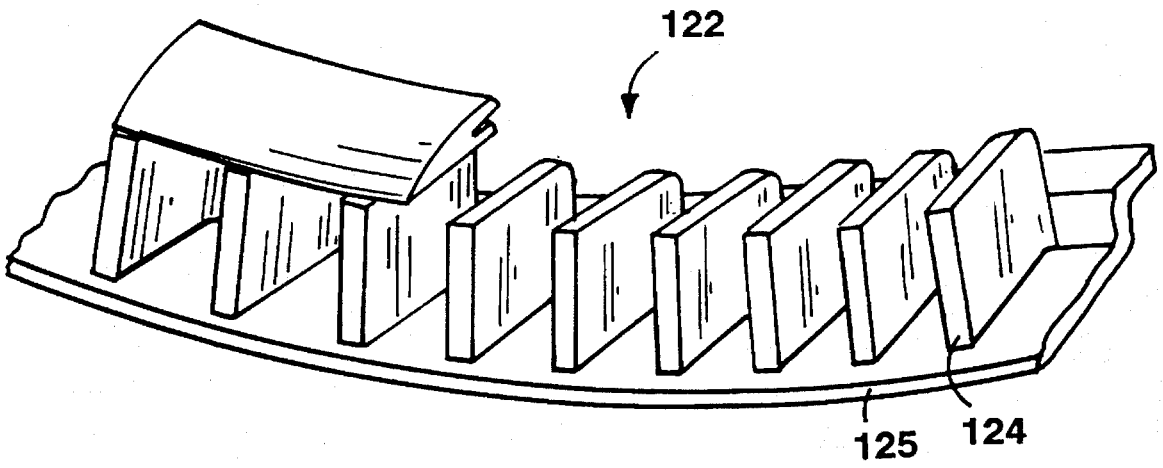

The two-part fan described above may be included in an airhandler assembly shown in FIGS. 5A–5B. Specifically, the assembly includes fan 80 positioned in a cylindrical wrapper/retainer 120 (shown essentially without thickness in FIG. 5A), which is preferably sheet metal. An integral injection molded plastic airflow recirculation guide ring 122, includes recirculation guide vanes 124. Ring 122 is positioned in wrapper 120 upstream of fan 80 generally as shown in FIG. 8 of U.S. Pat. No. 5,297,931, referenced above. The recirculation guide vanes may be shaped as described elsewhere in the '931 patent.

Other parts are positioned in retainer 120 downstream from fan 80. A flexible plastic, non-structural conical airguide 126 guides flow from the fan into pressure recovery stators surfaces 132. Injection molded stator assembly 128 is designed to remove the rotational component of fan exhaust. Specifically, stator members 130 having flow control surfaces 132 extending outwardly from a motor support 136 to surfaces at the circumference of the stator assembly. Electric motor 138 is positioned in motor support 136. Fan parts 20 and 60 are assembled to a metal sleeve 190 using screws 192. Sleeve 190 is then assembled to the shaft 194 of motor 138.

All of the assembly parts described above (fan 80, recirculation ring 122, conical airguide 126, and stator assembly 128) are injection molded plastic, with the exception of the sheet metal wrapper. When assembly is complete, recirculation guide ring 122, airguide 126, and stator assembly 128 (with the motor 138 and fan parts 20 and 60 attached to it) are positioned within sheet metal wrapper 120. Ring 122, airguide 126, and stator assembly 128 each include multiple keys 123, 129, and 139, extending radially outward from their respective smooth circumferential surfaces 125, 131, and 141, to fit within corresponding holes 135, 137, and 143 of retainer 120, once assembly is complete. For example each part has at least three keys to restrict all degrees of freedom in the assembly. Three fastening clips maintain the retainer in its cylindrical configuration, To assemble the airhandler, fan parts 20 and 60 are fit together (with keys indicating rotational position to ensure proper balancing) and attached to sleeve 190. Motor 138 is attached to stator 128. The assembled fan 80 is then attached to the motor shaft 194. The fan-motor and stator assembly is balanced in two planes. The resulting assembly of fan 80, motor 138 and stator assembly 128 is placed in an assembly fixture. Airguide 126 is fit over fan 80 and supported in place by a feature of the fixture. Inlet recirculation flow guide ring 122 is supported in its proper location by a separate fixture feature. Wrapper 120 is provided as a rectangular sheet of metal, and opposing sheet edges are brought together to form a cylinder, with keys 123, 129, and 139 held in position in holes 135, 137, and 143 with the fastening clips 140. The retainer is thus completely fastened around the stator assembly 128, conical airguide 126, and the recirculation ring 122. Because motor 138 is fixed to stator assembly 128, and fan parts 20 and 60 are fixed to the motor shaft, fan 80 is also fixed in place.

III. The Bell Mouth Airguide

In FIGS. 6A–6F, an airhandler assembly (for example, but not necessarily, the assembly described above) is attached immediately downstream of a rectangular heat exchanger, (in this case a rectangular heat exchanger, one of which is shown as 150) positioned at an angle of about 15° symmetrically about the fan axis. The fan nearly spans the width of the "V". A bell mouth surface 152 comprises a linear aerodynamic region parallel to, and at the downstream end of, at least one of the rectangular heat exchanges; surface 152 flares smoothly into an axisymmetric region 156 around the fan. The bell mouth surface(s) guides airflow smoothly as it leaves the heat exchanger bank at an angle of about 75° relative to the fan axis and turns axially to flow into the fan.

Another function of the bell mouth surface involves the extraction of heat and humidity (condensation) from the air, and the resulting production of water which must be guided out of the assembly. The airhandler assembly may be positioned so that airflow is downward. If so, the channel 158 may serve to collect condensation flowing down from the banks, and those surfaces guide the water to outlets 160.

Figure 6A:
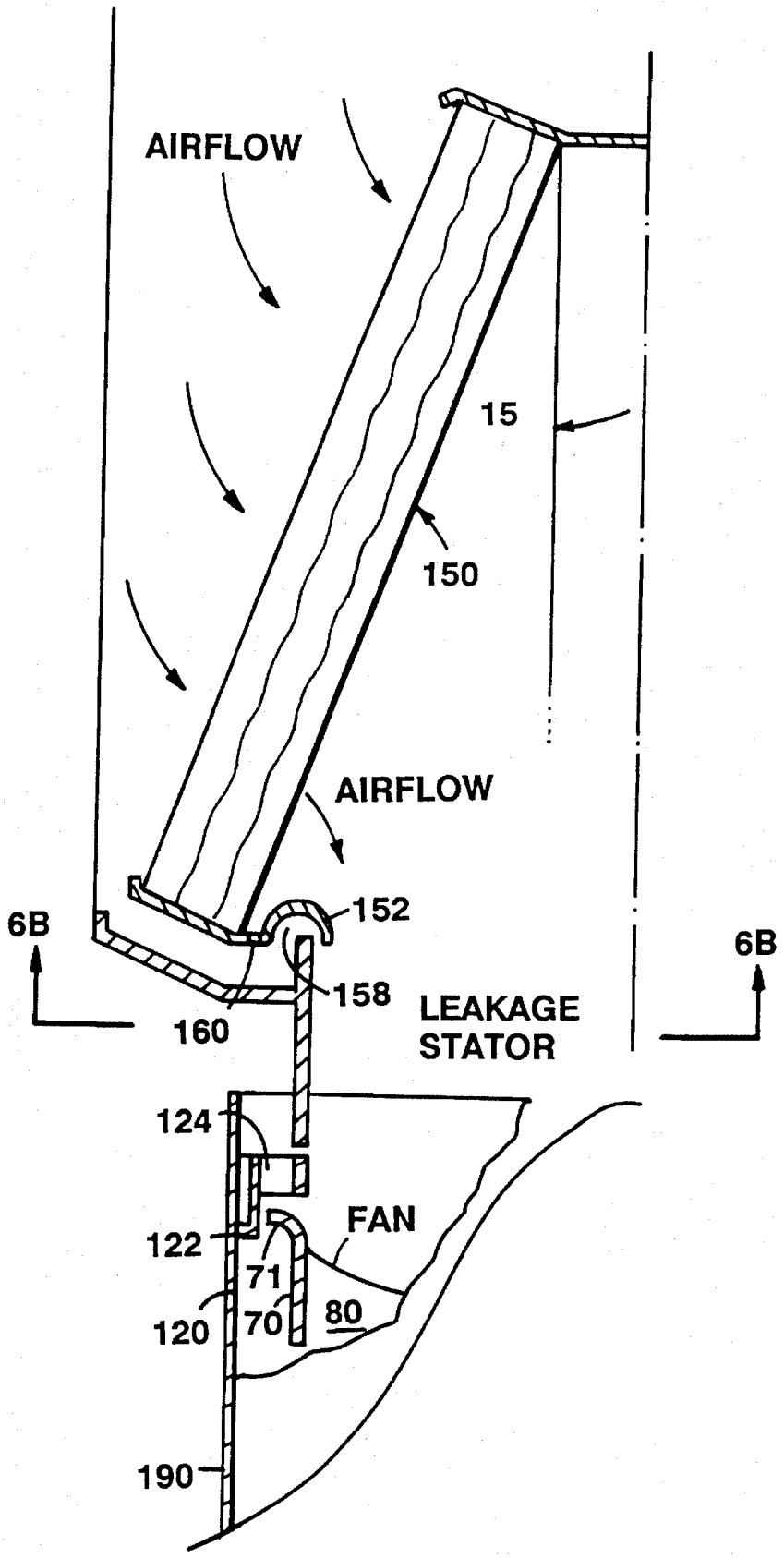
FIGS. 6A–6F illustrate a bell mouth that guides airflow from a heat exchanger to the fan.
Figure 6B:
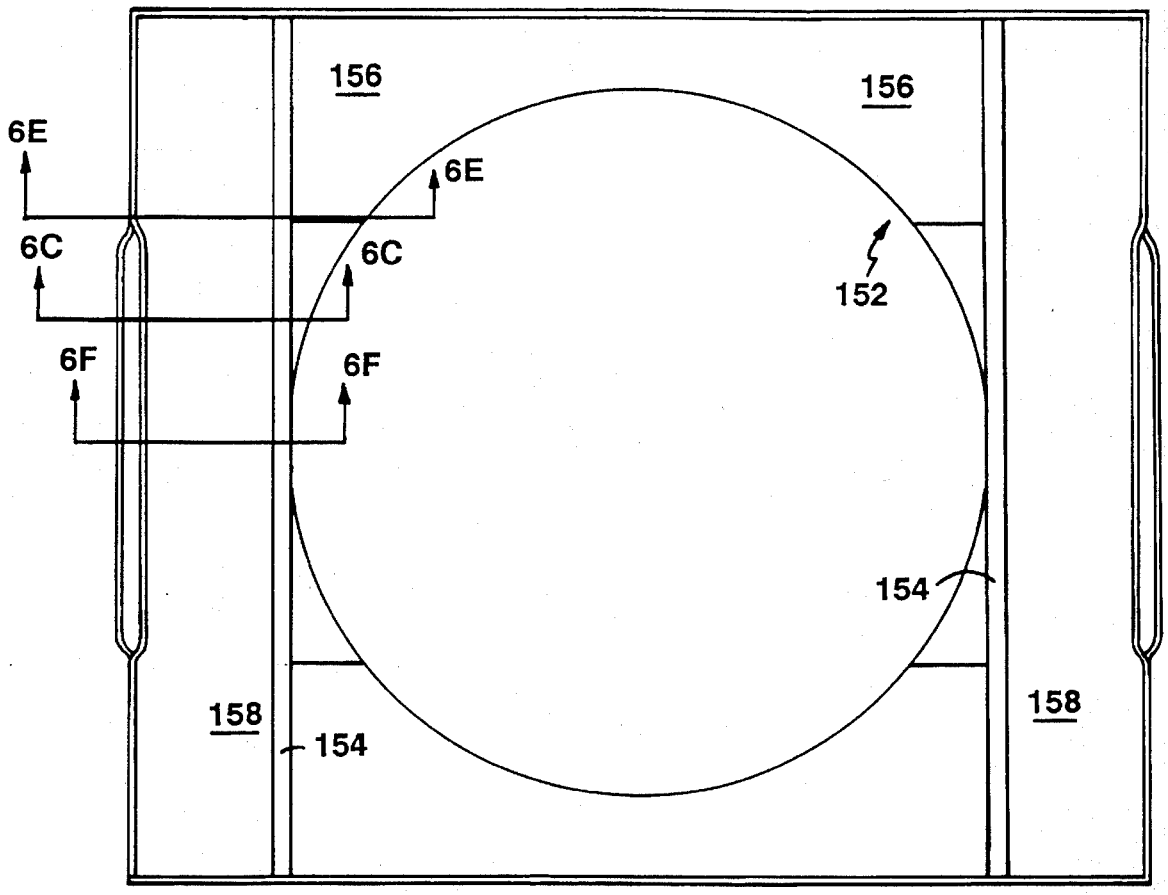
Figure 6C:
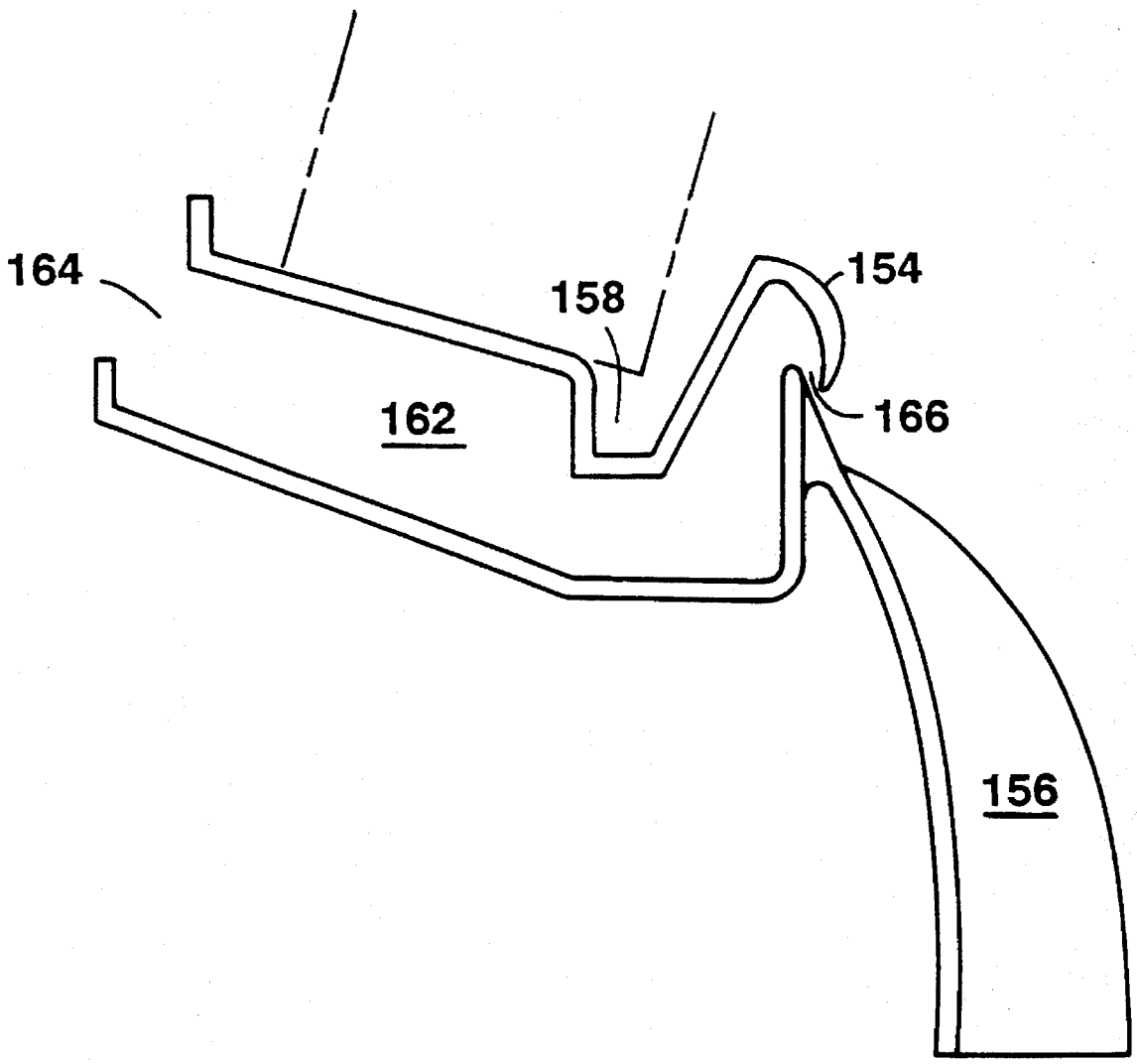
Figure 6F:
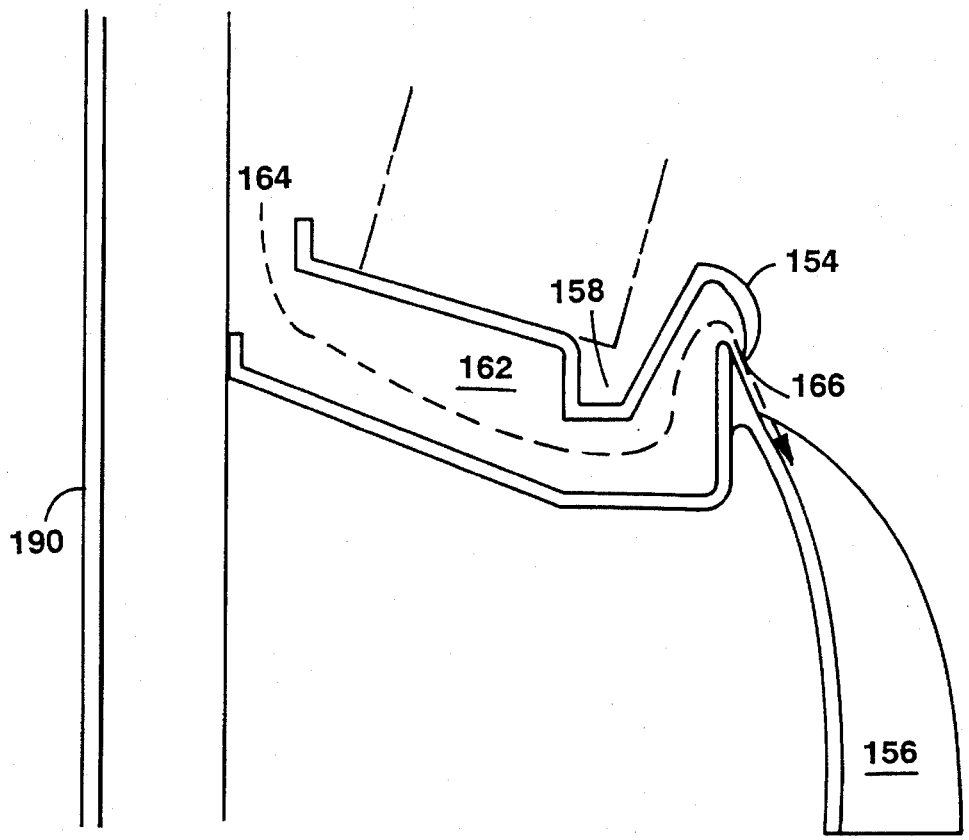
Figure 6D:
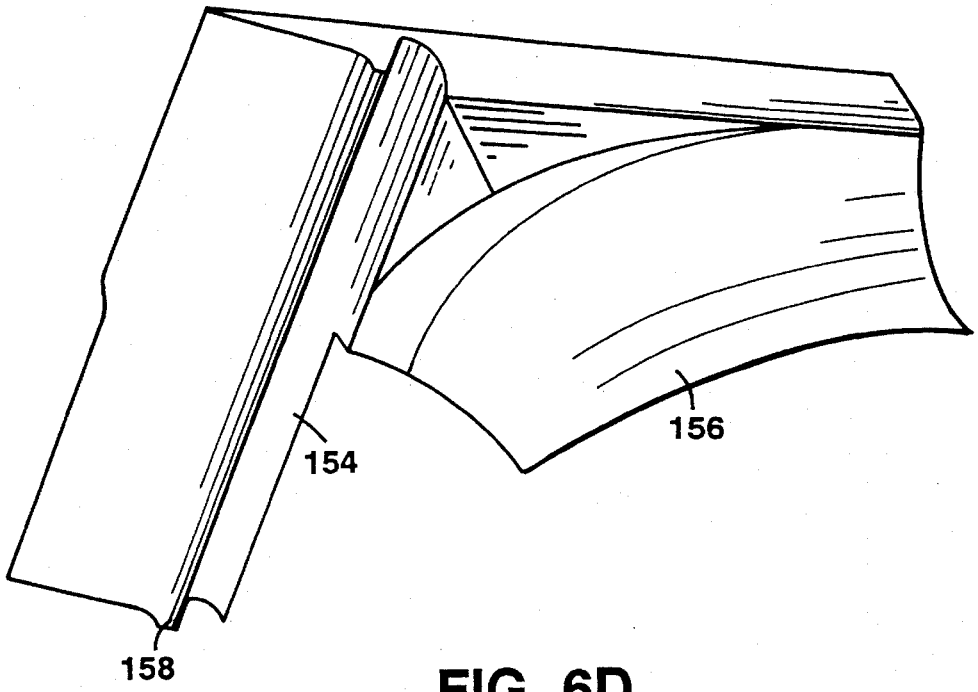
Figure 6E:
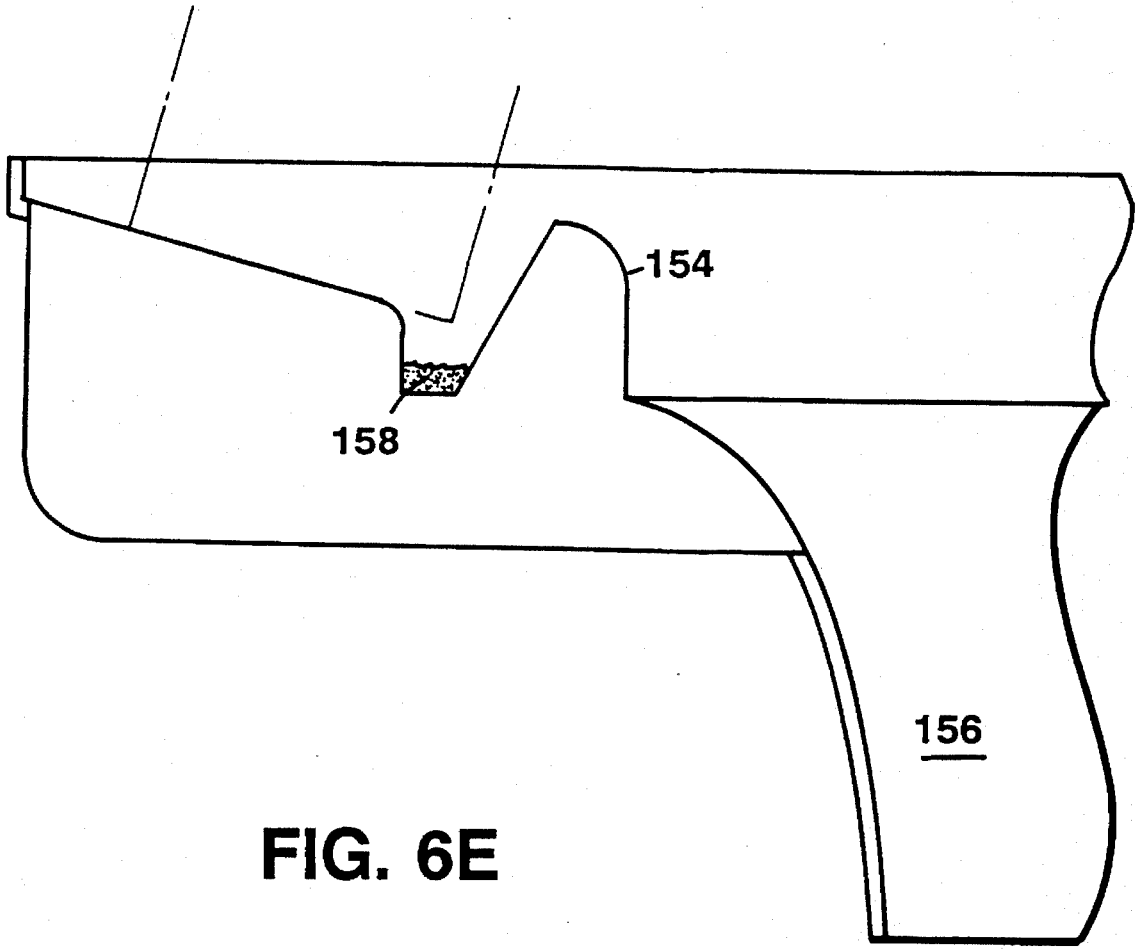

One option (by no means an essential part of the invention) is the inclusion of passage 162 between elongated inlet 164 and elongated outlet 166 (FIGS. 6C and 6F) under the linear bell mouth surfaces so that a small amount of airflow (1–2%) shown by dotted lines in FIG. 6F bypasses the heat exchanger, forming a jet downstream of the linear aerodynamic surfaces. The jet helps to turn each leg of the airflow and to keep it attached to the bell mouth surface.

Other embodiments are within the following claims. For example, fans with three or more parts are within the claims. The curved bell mouth surface may be used with other heat exchanger arrangements, for example a single rectangular heat exchanger positioned at an oblique angle to the round fan opening. The inlet flow-control vanes may be positioned between concentric rings that are not rigid by themselves, even though the entire structure (see FIG. 5B) provides rigidity to the outer ring.

What is claimed is:

1. A plastic fan comprising the following parts:

(a) an integral injection molded first fan part comprising a first hub and a first set of blades extending outwardly from the first hub to a first band; and (b) an integral injection molded second fan part comprising a second hub and a second set of blades extending outwardly from the second hub to a second band;

the first fan part and the second fan part being co-operatively sized and shaped to be assembled into a single operable fan which includes: (i) a hub comprising the first hub and the second hub; (ii) blades of the first set of blades and the second set of blades; and (iii) a circumferential fan band comprising the first fan band and the second fan band, the circumferential fan band connecting the tips of the fan blades.

2. The fan of claim 1 in which a projection of the blades of the fan in a plane perpendicular to the fan axis covers at least 80% of the area between $R_0$, the radius of the hub of the fan and R, the radius at the tip of the fan blades.

3. The fan of claim 1 in which a projection of the blades of the fan in a plane perpendicular to the fan axis covers at least 95% of the area between $R_0$, the radius of the hub of the fan and R, the radius at the tip of the fan blades.

4. The fan of claim 1 in which the first hub is axially forward of the second hub.

5. The fan of claim 1 or claim 4 in which the fan blades are raked forwardly.

6. The fan of claim 4 in which the first hub comprises an irregular trailing edge and the second hub comprises an irregular leading edge that mates with the irregular trailing edge of the first hub.

7. The fan of claim 6 in which the trailing edge of the first hub is shaped to define castellations that mate with corresponding castellations of the leading edge of the second hub.

8. The fan of claim 4 in which the first hub has a forward face that is rounded, presenting a smooth surface to incoming airflow.

9. The fan of claim 1 in which: a) the first band extends circumferentially around the first part to connect the tips of the blades in the first set; b) the second band extends circumferentially around the second part to connect the blades in the second set; c) the first band comprises an irregular trailing edge; and d) the second band comprises an irregular leading edge that mates with the trailing edge of the first band.

10. The fan of claim 1 in which blades in the first set of blades alternate around the fan circumference with blades in the second set of blades.

11. The fan of claim 1 in which each of the sets of blades includes at least 5 blades, and the fan includes at least 10 blades.

12. The fan of claim 1 in which each of the sets of blades includes at least 7 blades, so that the fan includes at least 14 blades.

13. The fan of claim 12 in which each of the sets of blades includes fewer than 15 blades, and the fan includes fewer than 30 blades.

14. The fan of claim 12 in which the fan includes either 20 or 22 blades.

15. The fan of claim 1 in which the fan comprises a fastener fixing the first hub to the second hub.

16. The fan of claim 1 in which the blades of the fan are arrayed symmetrically around the fan axis.

17. The fan of claim 1 in which the leading edges of the blades are forwardly skewed.

18. The fan of claim 1 in which the mid-chord skew of the fan blades is between 17 and 25 degrees.

19. The fan of claim 17 or claim 18 in which the blades are characterized by essentially straight leading edges in the region $0.76<r/R<0.99$.

20. The fan of claim 17 or claim 18 in which the blade leading edges are characterized by curvature between 0.76 r/R and 0.99 r/R such that $X<0.03$ L, where L is the length of a straight line connecting the leading edge at 0.99 R with the leading edge at 0.76 R, and X is the maximum distance between the straight line and the leading edge.

* * * * *